US005532443A

United States Patent [19]

Tsuji et al.

[11] Patent Number: 5,532,443

[45] Date of Patent: Jul. 2, 1996

[54] PRESSURE CONTACT TERMINAL

[75] Inventors: Masanori Tsuji; Kimihiro Abe; Osamu Sugiyama; Hiroshi Yamamoto; Sakai Yagi, all of Shizuoka-ken, Japan

[73] Assignee: Yazaki Corporation, Tokyo, Japan

[21] Appl. No.: 365,082

[22] Filed: Dec. 28, 1994

[30] Foreign Application Priority Data

Dec. 29, 1993 [JP] Japan ..... 5-353835

[51] Int. Cl.[6] ..... H01H 1/06

[52] U.S. Cl. ..... 200/275.000; 200/283.000; 200/238.000

[58] Field of Search ..... 200/275, 51.13, 200/238, 252, 254, 252, 283, 284; 28/622

[56] References Cited

U.S. PATENT DOCUMENTS 5,199,554 4/1993 Kano et al. ..... 200/275

FOREIGN PATENT DOCUMENTS 1-155673 10/1989 Japan .
2-299176 12/1990 Japan .
3-127770 12/1991 Japan .

*Primary Examiner*—David J. Walczak
*Attorney, Agent, or Firm*—Wigman, Cohen, Leitner & Myers

[57] ABSTRACT

A pressure contact terminal (50) comprises: a main body (60) having an elongate main base plate (61), a pair of two front side plates (62) and a pair of two middle side plates (64) both formed by bending both sides of the main base plate; and a spring member (70) having a spring base plate (71), a spring piece (72) formed by turning down a front end of the spring base plate, and at least one pressure contact plate (74) formed by bending a rear end of the spring base plate at a right angle so as to be connected to wire conductor. After the spring member has been assembled with the main body, the two front side plates (62) being further bent into a box shape to form a male terminal pressure contact portion in cooperation with the spring piece (72) of the spring member (70). Since the spring piece (72) and the pressure contact plate (74) are formed integral with each other by the single spring member (70) of high elasticity, a male terminal can be pressure-connected to the wire conductor via only the single spring member (70), so that the electric contact reliability can be improved. Further, the spring member (70) can be manufactured simply through only bending process.

19 Claims, 3 Drawing Sheets

PRESSURE CONTACT TERMINAL

BACKGROUND OF THE INVENTION

1. Technical Field

The present invention relates to a pressure contact terminal, and more specifically to a pressure contact terminal of two-part structure having a spring piece for providing a secure contact pressure for a mated terminal.

2. Description of the Related Art

FIGS. 1A and 1B show an example of prior art pressure contact terminals of two-part structure, which is disclosed in Japanese Published Unexamined Utility Model Application No. 3-127770. This prior art contact pressure terminal 1 of two-part structure is roughly composed of a main body 2 and a pressure contact member 3. This contact pressure terminal 1 is used being pressure-connected with an end conductor of an electric wire 4.

The main body 2 is formed with a box portion 21 and a spring piece 22 both formed integral with the main body 2. The box portion 21 accommodates a male terminal 5 mated with the female contact pressure terminal 1, and the spring piece 22 provides a secure contact pressure to the mated male terminal 5. On the rear side (the right side in FIG. 1A), a pair of side plates 23 are vertically provided, and further two wire supporting walls 23*a* are formed on each of the front and rear sides of the side plates 23 by bending the front and rear ends of the two wire supporting walls 23*a* inward, respectively. Further, between the two wire supporting walls 28*a* on both the front and rear sides, two vertical walls 24 are formed, as shown in FIG. 1B, so as to provide a gap 25 between the two wire supporting walls 23*a* and each vertical wall 24, respectively.

The pressure contact member 3 separated from the main body 2 is of U-shaped, which is formed with two opposing pressure contact plates 31 arranged with an interval in the wire extending direction. Each pressure contact plate 31 is formed with a pressure contact groove 32 extending beginning from the middle thereof in the vertical direction and with a pressure contact blade 33 inclined downward and outward at the lower end thereof. Therefore, when the pressure contact member 3 is pushed downward into the gaps 25 formed between the wire supporting walls 23*a* and the vertical walls 24 from above, since the pressure contact blade 33 cuts off the wire cover of a wire 4 mounted on the two wire supporting walls 23*a*, the internal conductor of the wire 4 is inserted into the pressure contact grooves 32, so that the conductor of the wire 4 can be connected to the pressure contact plate 31 electrically.

Further, under these conditions, when the male terminal 5 is inserted into the box portion 21 of the pressure contact terminal 1 from the front side, it is possible to connect the male terminal 5 with the wire 4 through three different contact portions of between the spring piece 22 in the box portion 21 and the male terminal 5, between the main body 2 and the pressure contact member 3, and between the pressure contact plates 31 and the wire 4.

In the above-mentioned prior art contact pressure terminal 1, however, after the male terminal 5 has been mated with the female pressure contact terminal 1, when the conduction conditions are not kept excellent at the three contact portions, respectively, the conduction reliability of the pressure contact terminal deteriorates as the whole. In other words, in the prior art contact pressure terminal, since the wire 4 is connected to the male terminal 5 via three different contact portions, there exists a problem in that there exists such a possibility that the conduction reliability of the terminal deteriorates easily.

SUMMARY OF THE INVENTION

With these problems in mind, therefore, it is the object of the present invention to provide a pressure contact terminal of high reliability in electric contact with wire.

To achieve the above-mentioned object, the present invention provides a pressure contact terminal, comprising: a main body (60) having an elongate main base plate (61), a pair of two front side plates (62) and a pair of two middle side plates (64) both formed by bending both sides of the main base plate; and a spring member (70) having a spring base plate (71), a spring piece (72) formed by turning down a front end of the spring base plate, and at least one pressure contact plate (74) formed by bending a rear end of the spring base plate at a right angle so as to be connected to wire conductor, after said spring member has been assembled with said main body, the two front side plates (62) being further bent into a box shape to form a male terminal pressure contact portion in cooperation with the spring piece (72) of said spring member (70).

Further, the main body (60) is formed with at least one engage slot (63) in each of the front side plates (62) and at least one engage slot (65) in each of the middle side plates (64), and said spring member (70) is formed with at least one engage projection (73) on each side of the spring base plate (71) so as to be engaged with the engage slot (63) formed in each front side plate (63) and with at least one engage projection (75) on each side of the pressure contact plate (74) so as to be engaged with the engage slot (65) formed in each middle side plate (64). Further, the main body (60) is further formed with a pair of wire clamping portions (66) for clamping wire pressure-connected to the pressure contact plate (74).

Further, the pressure contact plate (74) of said spring member (70) is formed with a pressure contact groove (76) into which a covering material of wire is pressure fit to connect wire conductor to the spring member (70).

Further, the pressure contact groove (76) has an outward opening wide groove portion (76*a*) and an inward extending narrow groove portion (76*b*).

Further, the spring member (70) is formed with two pressure contact plates (84) spaced in extending direction of said spring member (70). The pressure spring member (70) is formed simply by bending a single plate.

In the pressure contact terminal according to the present invention, since the number of contact portions between the mated male terminal and the wire conductor can be reduced as compared with the prior art pressure contact terminal, it is possible to improve the connection reliability of the terminal. Further, since the spring piece and the pressure contact plate can be formed by use of the same material of high elasticity, it is possible to improve the elasticity of the spring piece while securing a sufficient strength of the pressure contact plate.

Further, since the pressure contact terminal of the present invention can be formed only through bending process, it is possible to manufacture the pressure contact terminal easily along an automatic mass production line.

Further, since the spring member is engaged with the main body by use of the engage projections and the engage slots, it is possible to assemble the spring member with the main body securely.

DETAILED DESCRIPTION OF THE PREFERRED EMBODIMENTS

The embodiments of the pressure contact terminal according to the present invention will be described hereinbelow with reference to the attached drawings.

Figure 1A:
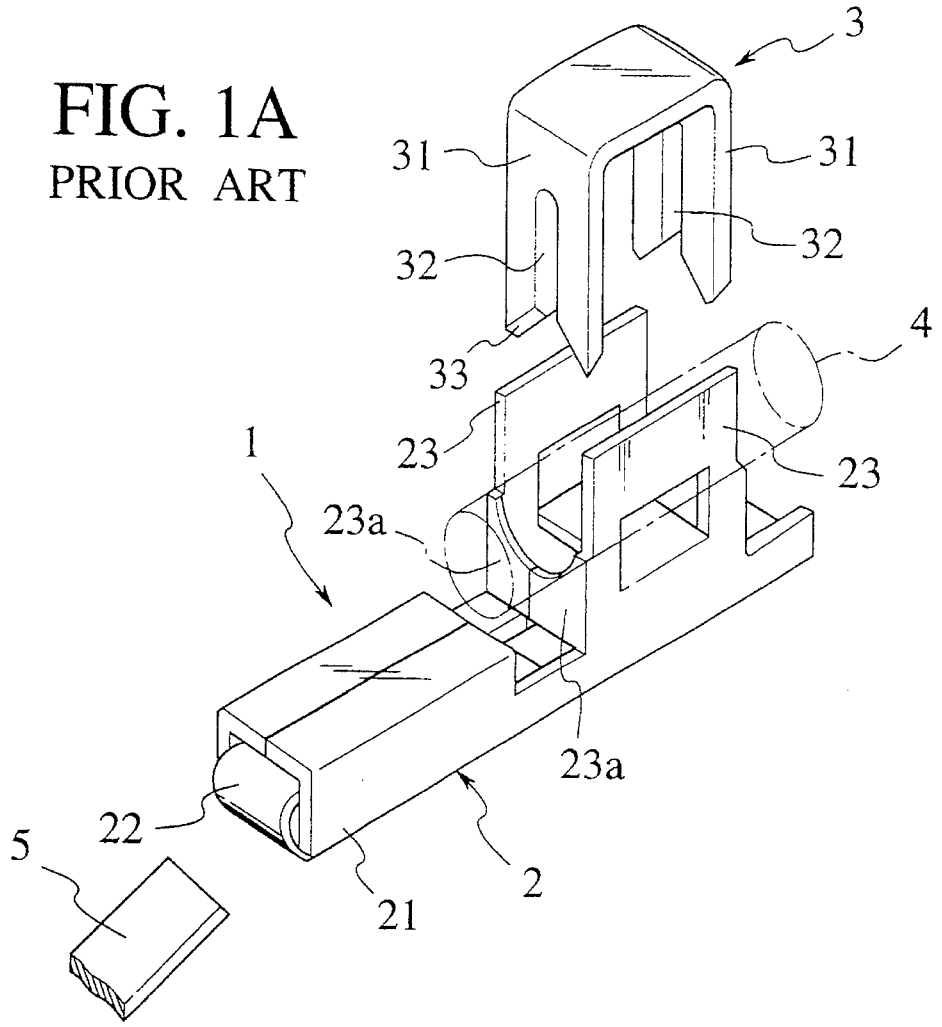
FIG. 1A PRIOR ART
FIG. 1A is a perspective view showing an example of prior art pressure contact terminal.
Figure 1B:
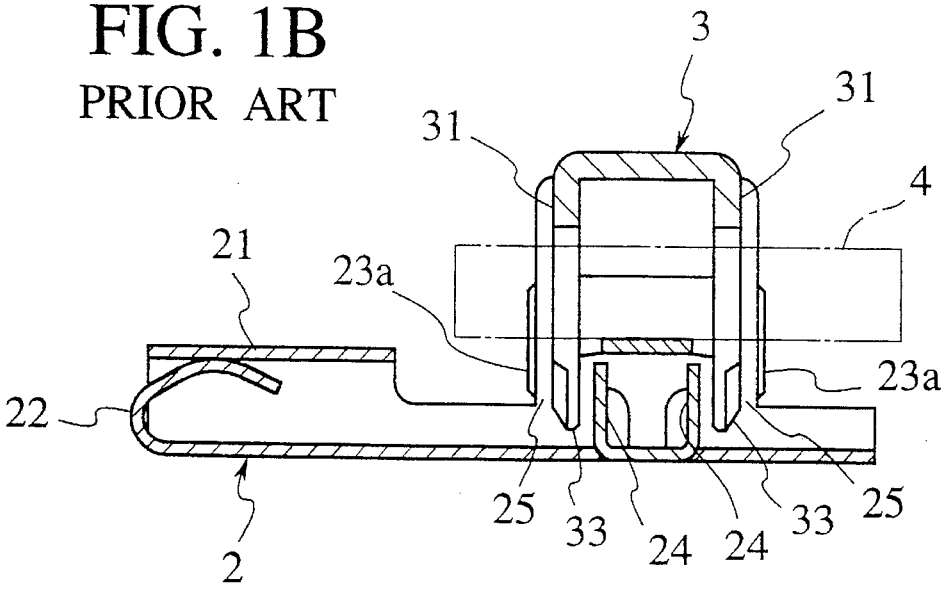
FIG. 1B PRIOR ART
FIG. 1B is a side view showing the same pressure contact terminal shown in FIG. 1A.
Figure 2A:
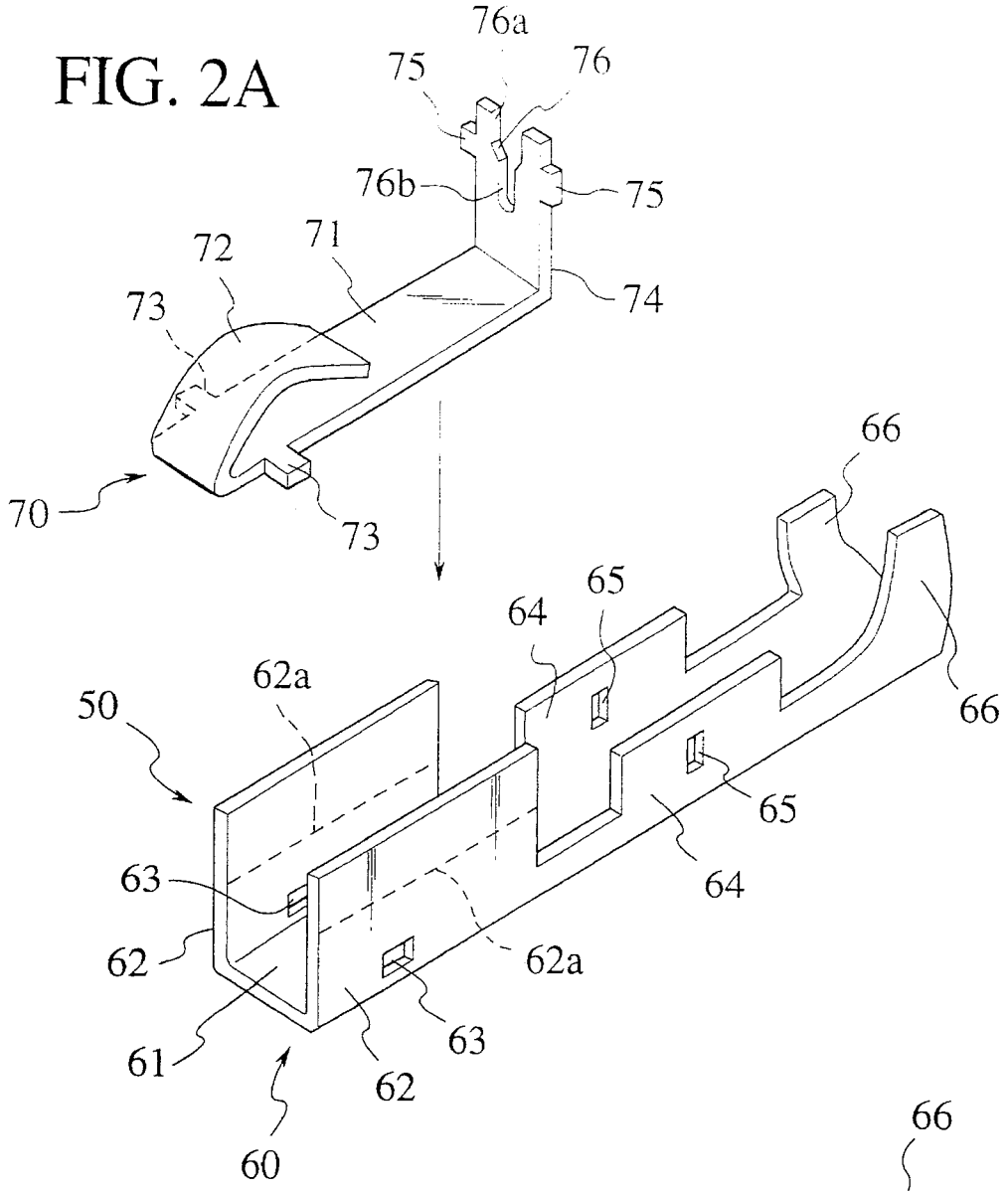
FIG. 2A is a perspective view showing an embodiment of the pressure contact terminal according to the present invention.
Figure 2B:
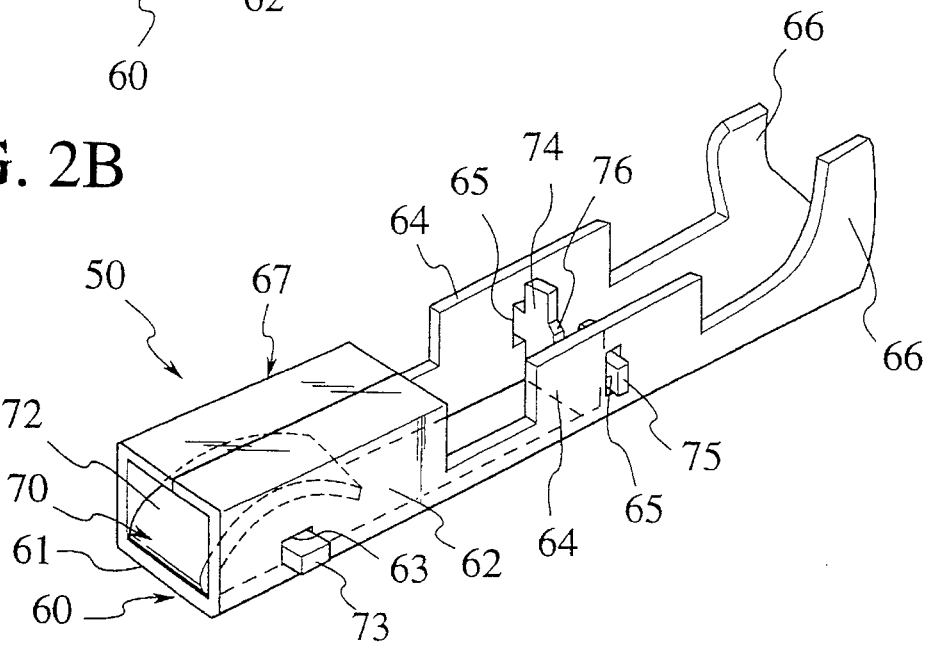
FIG. 2B is a side view showing the same pressure contact terminal shown in FIG. 2A.

FIGS. 2A and 2B show a first embodiment of the present invention, in which the contact pressure terminal 50 is roughly composed of a main body 60 formed of a material of low elasticity and a spring member 70 formed of a material of high elasticity.

The main body 60 is formed into a U-shaped cross section and with an elongate base plate 61, a pair of front side plates 62, a pair of middle side plates 64, and a pair of rear side wire clamping plates 66 all formed continuously and integrally. Further, each front side plate 62 is formed with an engage slit 63 extending in the horizontal direction; and each middle side plate 62 is formed with an engage slit 65 extending in the vertical direction. Further, after the spring member 70 has been assembled with the main body 60, the upper half portion of each front side plate 62 is bent inward along a bending line 62a (see FIG. 2A) to form a box portion 67 as shown in FIG. 2B.

On the other hand, the spring member 70 is composed of a spring piece 72 formed by turning down a front end of an elongate spring base plate 71 on the front side thereof and a pressure contact plate 74 formed by bending up a rear end of the same spring base plate 71 at a right angle on the rear side thereof. Further, the spring member 70 is formed with two side engage projections 73 extending outward on both sides of the spring base plate 71 in the vicinity of the bending position of the spring piece 72 and with two similar side engage projections 75 extending outward on both sides of the pressure contact plate 74. Further, the pressure contact plate 74 is formed with a pressure contact groove 76 extending downward from the upper middle end thereof. In more detail, the pressure contact groove 76 is formed with an outward opening wide groove portion 76*a* and a downward extending narrow groove portion 76*b*.

To assemble the spring member 70 with the main body 60, as shown by an arrow in FIG. 2A, the spring member 70 is inserted into the U-shaped main body 60. Further, as shown in FIG. 2B, the engage projections 73 and 75 of the spring member 70 are both engaged with the engage slots 63 and 65 of the main body 60. After the spring member 70 has been coupled with the main body 60, the front side plates 62 of the main body 60 are bent along the bending lines 62*a* inward to form the box portion 67 for accommodating the spring piece 72.

To connect a wire with the pressure contact terminal 50, an end of the wire is placed on the pressure contact terminal 50, and then the wire (having a cover material) is pushed into the pressure contact groove 76 of the pressure contact plate 74 of the spring member 70 under pressure. In this case, since the wire cover material is cut off by the pressure contact groove 76, the wire conductor can be directly connected to the pressure contact plate 74 of the spring member 70. After that, the wire clamping portions 66 are bent inward to clamp the wire by the pressure contact terminal 50. The pressure contact terminal 50 to which the wire is clamped is inserted into a connector housing (not shown) to complete a connector. Further, when a mated male terminal (not shown) is inserted into the box portion 67 of the main body 60, since the male terminal is brought into pressure contact with the spring piece 72 within the box portion 67 of the main body 60, it is possible to connect the male terminal with the wire through the pressure contact plate 74 formed integral with the spring piece 72. In other words, since the male terminal can be connected to the wire conductor through only one spring member 70, that is, through two contact portions between the male terminal and the spring piece 72 and between the pressure contact plate 74 and the wire conductor, it is possible to reduce the number of contact portions by one as compared with the prior art pressure contact terminal, so that the connection reliability can be improved to that extent. In addition, since the spring member 70 is formed of a material of high elasticity, it is possible to connect the male terminal with the spring piece 72 under a strong and reliable contact pressure as compared with the prior art pressure contact terminal (because the material of the spring piece 2 is low in elasticity), so that the contact reliability can be further improved.

Further, the contact pressure plate 74 is formed of a material of high elasticity, a sufficient strength can be obtained in the contact pressure plate 74. In addition, since the spring member 70 is fixed to the main body 60 by use of four engage projections 63 and 65 on both front and rear sides of the main body 60, it is possible to assemble the spring member 70 with the main body 60 securely under well balanced conditions. Further, since the spring member 70 is formed by bending a single elongate plate, it is possible to reduce the manufacturing cost of the pressure contact terminal 50. Further, when the wire diameter is different, only the spring member 70 is replaced with another one according to the wire, without changing the main body 60, so that it is possible to standardize the main body 60 for all the wires of different diameters.

Figure 3A:
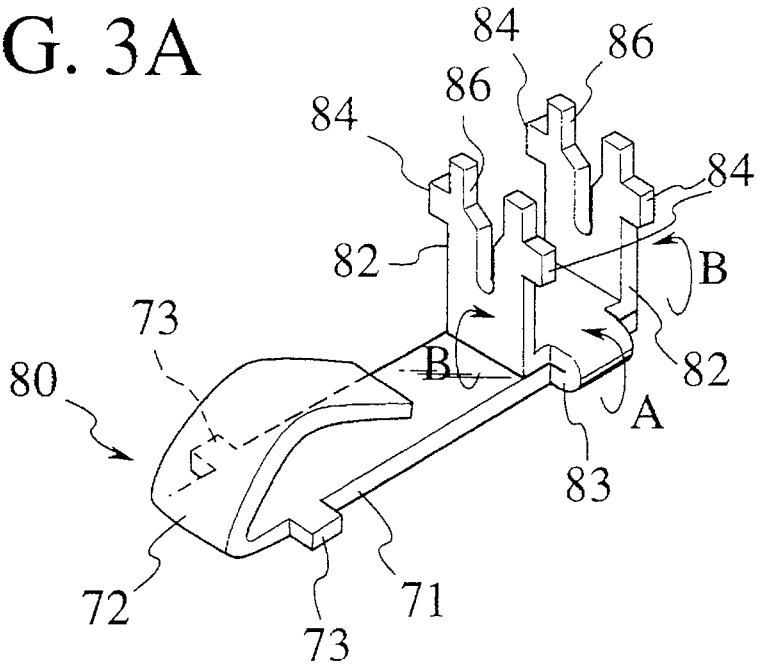
FIG. 3A is a perspective view showing a spring member of another embodiment of the present invention.
Figure 3B:
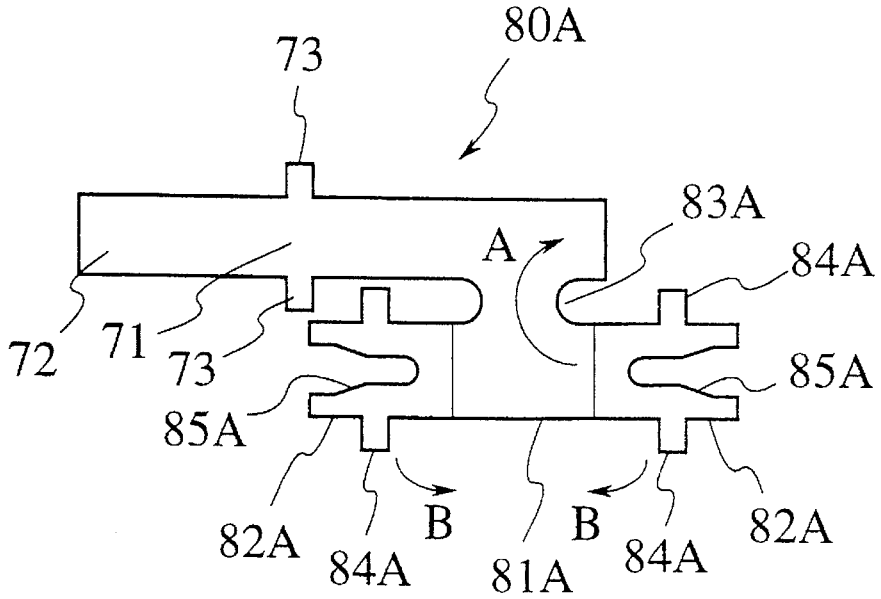
FIG. 3B is a development view showing the spring member of the embodiment shown in FIG. 3A.

FIGS. 3A and 3B show a second embodiment of the present invention, in which the spring member 80 is formed with two pressure contact plates 82 spaced in the wire extending direction. In the same way as with the case of the first embodiment shown in FIGS. 2A and 2B, each pressure contact plate 82 is formed with two engage projections 84 and one pressure contact groove 86, respectively.

Further, FIG. 3B is a development view of the spring member 80, in which the respective portions are shown by adding A to the numerals for denoting the respective portions of the completed terminal shown in FIG. 3A. In FIG. 3B, the developed spring member 80A has a spring piece 72 and two engage projections 73 on the front end of the base plate 71, and a bend piece 81A connected to the rear end of and on one side of the base plate 71 via a bending portion 83A. In more detail, the pressure contact plates 82A are formed on both front and rear sides of the bend piece 81A.

To form the spring member 80 as shown in FIG. 3A, the spring piece 72 is bent upward and then bent downward (turning down). Further the bend piece 81A is bent in the direction A shown in FIG. 3B until the bend piece 81A is overlapped with the base plate 71. Under these conditions, the two contact pressure plates 82A are bent in the direction B perpendicular to the bend piece 81A, with the result that it is possible to form the spring member 80 as shown in FIG. 3A from a single plate through only the bending process.

The spring member 80 constructed as described above is assembled with the main body 60 in the same way as with the case of the first embodiment to complete the pressure contact terminal of the second embodiment. In this second embodiment, however, since two pressure contact plates 82 are provided and each pressure contact plate 82 is formed with two engage projections 84, it is necessary to form four engage slots 65 in the middle side plates 64 of the main body 60.

In the second embodiment of the contact pressure terminal according to the present invention, since two pressure contact plates 82 are formed and the wire is pressure-connected to the two pressure contact plates 82, the connection reliability can be further improved from both the electrical and mechanical standpoints. Further, in the same way as with the case of the first embodiment, since the spring member 80 can be formed by bending a single plate, it is possible to easily manufacture the spring member 80 at a low cost.

Further, without being limited to only the above-mentioned embodiments, the main body 60 and the spring member 70 can be both manufactured by various process other than the bending process. Further, the number of the pressure contact plates is not limited to only one or two; that is, it is also possible to use three or more pressure contact plates.

As described above, in the pressure contact terminal according to the present invention, since the number of contact portions between the mated male terminal and the wire conductor can be reduced, it is possible to improve the connection reliability of the terminal. Further, since the spring piece and the pressure contact plate can be formed by use of the same material of high elasticity, it is possible to improve the elasticity of the spring piece while securing a sufficient strength of the pressure contact plate.

Further, since the pressure contact terminal can be formed only through bending process, it is possible to manufacture the pressure contact terminal easily along an automatic mass production line.

Further, since the spring member is engaged with the main body by use of the engage projections and the engage slots, it is possible to assemble the spring member with the main body securely.

What is claimed is:

1. A pressure contact terminal, comprising:

a main body having an elongate main base plate, two front side plates, two middle side plates, and two rear side plates, said side plates being formed by bending sides of the main base plate; and a spring member formed separately from said main body and having a spring base plate, a spring piece formed by turning down a front end of the spring base plate, and at least one pressure contact plate formed by bending a rear end of the spring base plate at a right angle and thereby adapted to be connected to a wire conductor after said spring member has been assembled with said main body, the two front side plates being further bent into a box shape to form, in cooperation with the spring piece of said spring member, a male terminal pressure contact portion.

2. The pressure contact terminal of claim 1, wherein said main body is formed with at least one engage slot in each of the two front side plates and at least one engage slot in each of the two middle side plates, and said spring member is formed with at least one engage projection on each side of the spring base plate so as to be engaged with said at least one engage slot formed in each of the two front side plates, and with at least one engage projection on each side of the pressure contact plate so as to be engaged with said at least one engage slot formed in each of the two middle side plates.

3. The pressure contact terminal of claim 1, wherein said two rear side plates form a pair of wire clamping portions for clamping wire pressure-connected to the pressure contact plate.

4. The pressure contact terminal of claim 1, wherein said at least one pressure contact plate of said spring member is formed with a pressure contact groove into which a covering material of wire is pressure fit to connect the wire conductor to the spring member.

5. The pressure contact terminal of claim 4, wherein the pressure contact groove has an outward opening wide groove portion and an inward extending narrow groove portion.

6. The pressure contact terminal of claim 1, wherein said spring member comprises two pressure contact plates spaced in an extending direction of said spring member.

7. The pressure contact terminal of claim 6, wherein said spring member is formed by bending a single plate.

8. The pressure contact terminal of claim 1, wherein said spring member is formed by bending a single plate.

9. The pressure contact terminal of claim 1, wherein said main body is formed with at least one engage slot in each of the two front side plates, said spring member being formed with at least one engage projection on each side of the spring base plate so as to be engaged with said at least one engage slot formed in each of the two front side plates.

10. The pressure contact terminal of claim 1, wherein said main body is formed with at least one engage slot in each of the two middle side plates, said spring member being formed with at least one engage projection on each side of the pressure contact plate so as to be engaged with said at least one engage slot formed in each of the two middle side plates.

11. A pressure contact terminal comprising:

a main body having an elongate main base plate, two front side plates, and two middle side plates, said side plates being formed by bending sides of the main base plate; and a spring member having a spring base plate, a spring piece formed by turning down a front end of the spring base plate, and at least one pressure contact plate formed by bending a rear end of the spring base plate at a right angle and thereby adapted to be connected to a wire conductor after said spring member has been assembled with said main body, the two front side plates being further bent into a box shape to form, in cooperation with the spring piece of said spring member, a male terminal pressure contact portion;

wherein said main body is formed with at least one engage slot in each of the two front side plates and at least one engage slot in each of the two middle side plates, said spring member being formed with at least one engage projection on each side of the spring base plate so as to be engaged with said at least one engage slot formed in each of the two front side plates, and with at least one engage projection on each side of the pressure contact plate so as to be engaged with said at least one engage slot formed in each of the two middle side plates.

12. The pressure contact terminal of claim 11, wherein said main body further comprises a pair of wire clamping portions for clamping the wire pressure-connected to the pressure contact plate.

13. The pressure contact terminal of claim 11, wherein said at least one pressure contact plate of said spring member is formed with a pressure contact groove into which a coveting material of wire is pressure fit to connect the wire conducted to the spring member.

14. The pressure contact terminal of claim 13, wherein the pressure contact groove has an outward opening wide groove portion and an inward extending narrow groove portion.

15. The pressure contact terminal of claim 11, wherein said spring member comprises two pressure contact plates spaced in an extending direction of said spring member.

16. The pressure contact terminal of claim 15, wherein said spring member is formed by bending a single plate.

17. The pressure contact terminal of claim 11, wherein said spring member is formed by bending a single plate.

18. A pressure contact terminal comprising:

a main body having an elongate main base plate, two from side plates, and two middle side plates, said side plates being formed by bending sides of the main base plate; and a spring member having a spring base plate, a spring piece formed by turning down a front end of the spring base plate, and at least one pressure contact plate formed by bending a rear end of the spring base plate at a right angle and thereby adapted to be connected to a wire conductor after said spring member has been assembled with said main body, the two front side plates being further bent into a box shape to form, in cooperation with the spring piece of said spring member, a male terminal pressure contact portion;

wherein said main body is formed with at least one engage slot in each of the two front side plates, said spring member being formed with at least one engage projection on each side of the spring base plate so as to be engaged with said at least one engage slot formed in each of the two front side plates.

19. A pressure contact terminal comprising:

a main body having an elongate main base plate, two front side plates, and two middle side plates, said side plates being formed by bending sides of the main base plate; and a spring member having a spring base plate, a spring piece formed by turning down a front end of the spring base plate, and at least one pressure contact plate formed by bending a rear end of the spring base plate at a right angle and thereby adapted to be connected to a wire conductor after said spring member has been assembled with said main body, the two front side plates being further bent into a box shape to form, in cooperation with the spring piece of said spring member, a male terminal pressure contact portion;

wherein said main body is formed with at least one engage slot in each of the two middle side plates, said spring member being formed with at least one engage projection on each side of the pressure contact plate so as to be engaged with said at least one engage slot formed in each of the two middle side plates.

* * * * *